US007717293B2

(12) United States Patent
Bellafatto et al.

(10) Patent No.: US 7,717,293 B2
(45) Date of Patent: May 18, 2010

(54) BAG HOLDER AND DISPENSER

(75) Inventors: Steven Bellafatto, Closter, NJ (US); Cheryl Ann Trivino, Hoboken, NJ (US); Robert Joachim, Glen Rock, NJ (US); Troy H. Phipps, Brooklyn, NY (US)

(73) Assignee: Helen of Troy Limited, St. Michael (BE)

( * ) Notice: Subject to any disclaimer, the term of this patent is extended or adjusted under 35 U.S.C. 154(b) by 0 days.

(21) Appl. No.: 11/983,093

(22) Filed: Nov. 7, 2007

(65) Prior Publication Data

US 2009/0114670 A1 May 7, 2009

(51) Int. Cl.
*G07F 11/00* (2006.01)

(52) U.S. Cl. ..... 221/92; 221/312 C

(58) Field of Classification Search ..... 221/25, 221/27, 33, 34, 35, 37, 38, 42, 44, 45, 46, 221/54, 55, 57, 58, 59, 60, 61, 62, 63, 64, 221/65, 68, 90, 92, 94, 95, 97, 98, 99, 100, 221/101, 102, 105, 159, 205, 241, 251, 252, 221/254, 263, 276, 277, 282, 301, 304
See application file for complete search history.

(56) References Cited

U.S. PATENT DOCUMENTS

| | | | | | |
|---|---|---|---|---|---|
| 392,942 | A | * | 11/1888 | Anger | 220/531 |
| 2,080,691 | A | | 5/1937 | Broeren | |
| 2,153,472 | A | * | 4/1939 | Morris | 221/35 |
| 2,522,386 | A | * | 9/1950 | Lindstrom et al. | 221/57 |
| 2,693,686 | A | * | 11/1954 | Pierce | 220/531 |
| 3,375,830 | A | * | 4/1968 | Dixon et al. | 220/529 |
| 3,720,346 | A | * | 3/1973 | Cypher | 220/533 |
| 4,739,894 | A | | 4/1988 | Pender | |
| 4,976,375 | A | | 12/1990 | Quam | |
| 4,978,018 | A | | 12/1990 | Wood | |
| 5,042,687 | A | | 8/1991 | McKinley | |
| 5,082,139 | A | | 1/1992 | Quam | |
| 5,147,119 | A | | 9/1992 | Harris | |
| D336,703 | S | | 6/1993 | Mason, Jr. et al. | |
| 5,285,927 | A | | 2/1994 | Pruitt | |
| 5,386,910 | A | * | 2/1995 | Liss | 206/554 |
| 5,511,691 | A | | 4/1996 | West, Jr. | |
| D406,973 | S | | 3/1999 | Thomas | |
| 5,947,277 | A | | 9/1999 | Sherman | |
| D415,914 | S | | 11/1999 | Shields | |
| D419,010 | S | | 1/2000 | Hansen et al. | |
| D431,735 | S | | 10/2000 | Sullivan | |
| 6,190,045 | B1 | | 2/2001 | Schulman | |
| 6,231,099 | B1 | * | 5/2001 | Greenwald | 296/37.8 |
| D482,915 | S | | 12/2003 | Yang et al. | |
| D501,136 | S | | 1/2005 | Shurman | |
| D501,401 | S | | 2/2005 | Shurman | |
| D502,622 | S | | 3/2005 | Berger | |
| D505,036 | S | | 5/2005 | Wilfong, Jr. | |
| D505,818 | S | | 6/2005 | Berger | |
| D507,715 | S | | 7/2005 | Yang et al. | |

(Continued)

*Primary Examiner*—Gene Crawford
*Assistant Examiner*—Kelvin L Randall, Jr.
(74) *Attorney, Agent, or Firm*—Seyfarth Shaw LLP

(57) ABSTRACT

A bag dispenser is provided. The bag dispenser includes at least one outer wall, an inner chamber located within the at least one outer wall, at least one opening in the at least one outer wall and an adjustable divider located with the inner chamber.

15 Claims, 6 Drawing Sheets

U.S. PATENT DOCUMENTS 6,913,386 B2 * 7/2005 Maher et al. ..... 383/38
7,044,329 B2 5/2006 Lum et al.
2003/0140826 A1 * 7/2003 Stinson ..... 109/24.1
2005/0199641 A1 9/2005 Yang et al.
2008/0264965 A1 * 10/2008 Reinsel et al. ..... 221/44

* cited by examiner

BAG HOLDER AND DISPENSER

FIELD OF THE INVENTION

This invention relates generally to a bag holder and dispenser, and in more particular applications to a bag holder and dispenser including an adjustable divider.

BACKGROUND

Plastic bags are commonly used for a variety of purposes to package and transport different goods. For example, supermarkets and other stores oftentimes provide plastic bags for customers to use for transporting purchased items. Additionally, plastic bags can be inexpensive and also are relatively compact for storage when not in use.

However, it is often desirable to recycle and/or reuse plastic bags. For example, customers may decide to save plastic bags from grocery stores for use as garbage bags, to transport items to and from their homes and for other uses.

It is often desirable to store plastic bags in a convenient location, such as the kitchen or pantry. For example, it is possible to store a number of plastic bags inside of one or more hanging plastic bags. Additionally, it is possible to store plastic bags in more rigid containers, such as thicker plastic walled containers. Oftentimes these containers have one or more openings to allow the user to quickly and easily access the stored plastic bags.

Furthermore, it may also be desirable to save and separate a variety of types of plastic bags. For example, a variety of different thicknesses and/or colors of bags may be desired to be separated from one another. For example, plastic bags from a grocery store may be relatively thin and therefore cannot support significant weight whereas plastic bags from a department store may be relatively thicker. Therefore, when a person reuses the plastic bags, it may be desirable to quickly grab a preferred type of bag depending on the end use.

SUMMARY

In one form, a bag dispenser is provided. The bag dispenser includes at least one outer wall, an inner chamber located within the at least one outer wall, at least one opening in the at least one outer wall providing access to the inner chamber and an adjustable divider located with the inner chamber.

According to one form, a bag dispenser is provided. The bad dispenser includes at least one outer wall, an inner chamber, a self-adjusting divider and movement restricting structure. The inner chamber being located within the at least one outer wall. The self-adjusting divider being located within the inner chamber. The self-adjusting divider having a full range of motion for overall movement and a free range of motion whereby the divider can freely move. The movement restricting structure restricting the self-adjusting movement of the divider to the free range of motion, wherein the movement restricting structure can be bypassed to increase the full range of motion of the divider.

According to one form, the adjustable divider is movable within the inner chamber to define a plurality of compartments.

In yet another form, the adjustable divider is movable within the inner chamber between a compartmentalizing position to define a plurality of compartments within the inner chamber and a non-compartmentalizing position to define a single compartment within the inner chamber.

In accordance with one form, the adjustable divider is a self adjusting divider.

According to one form, the adjustable divider is operably coupled to the inner chamber via a hinge to permit the adjustable divider to rotate about an axis.

In one form, the bag dispenser further includes a protrusion located on the inner chamber and a groove located on the adjustable divider, the protrusion cooperating with the groove to permit the adjustable divider to move between a compartmentalizing position and a non-compartmentalizing position.

In accordance with one form, the adjustable divider is biased to the compartmentalizing position whereby the protrusion is not permitted to enter the groove.

According to one form, the bag dispenser is capable of freely standing on a surface.

In accordance with one form, the bag dispenser is wall mountable.

In one form, at least a portion of the outer wall is arc-shaped and at least a portion of the inner chamber is arc-shaped.

Other forms are also contemplated as understood by those skilled in the art.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its constructions and operation, and many of its advantages should be readily understood and appreciated.

DETAILED DESCRIPTION

Figure 1:
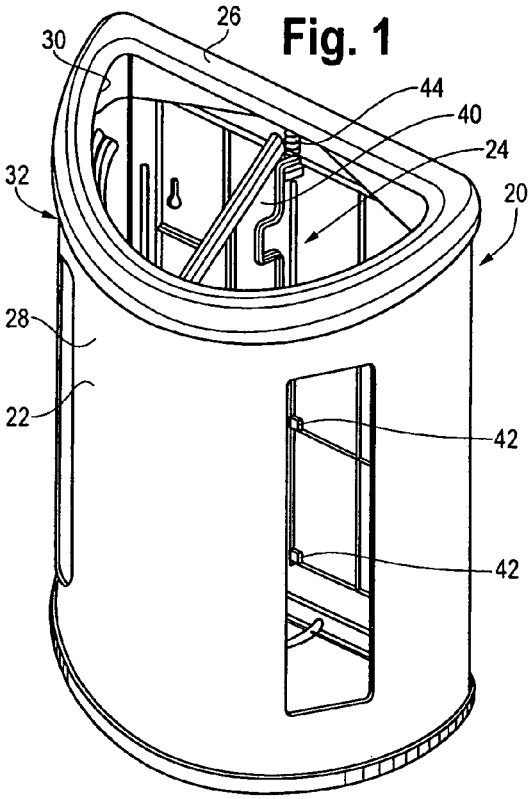
FIG. 1 is perspective view of a bag dispenser including an adjustable divider.

Referring to FIG. 1, one form of a bag dispenser 20 is illustrated. The bag dispenser 20 includes an outer wall 22 and an inner chamber 24 defined by the outer wall 22. It should be understood that the inner chamber 24 can be defined by other structure, such as an intermediate wall (not shown). As illustrated, the outer wall 22 has a generally flat back wall portion 26 and an arced wall portion 28. However, it should be understood that a variety of wall shapes, sizes and orientations may be used. For example, four straight walls may be used such that the resultant bag dispenser is rectangular-shaped.

In one form, the bag dispenser 20 includes an opening 30 in an upper portion 32 of the bag dispenser 20. The opening 30 can be used to insert plastic bags (not shown) into the dispenser 20. It should be noted that the opening 30 is not required and may be omitted if desired.

Figure 7:
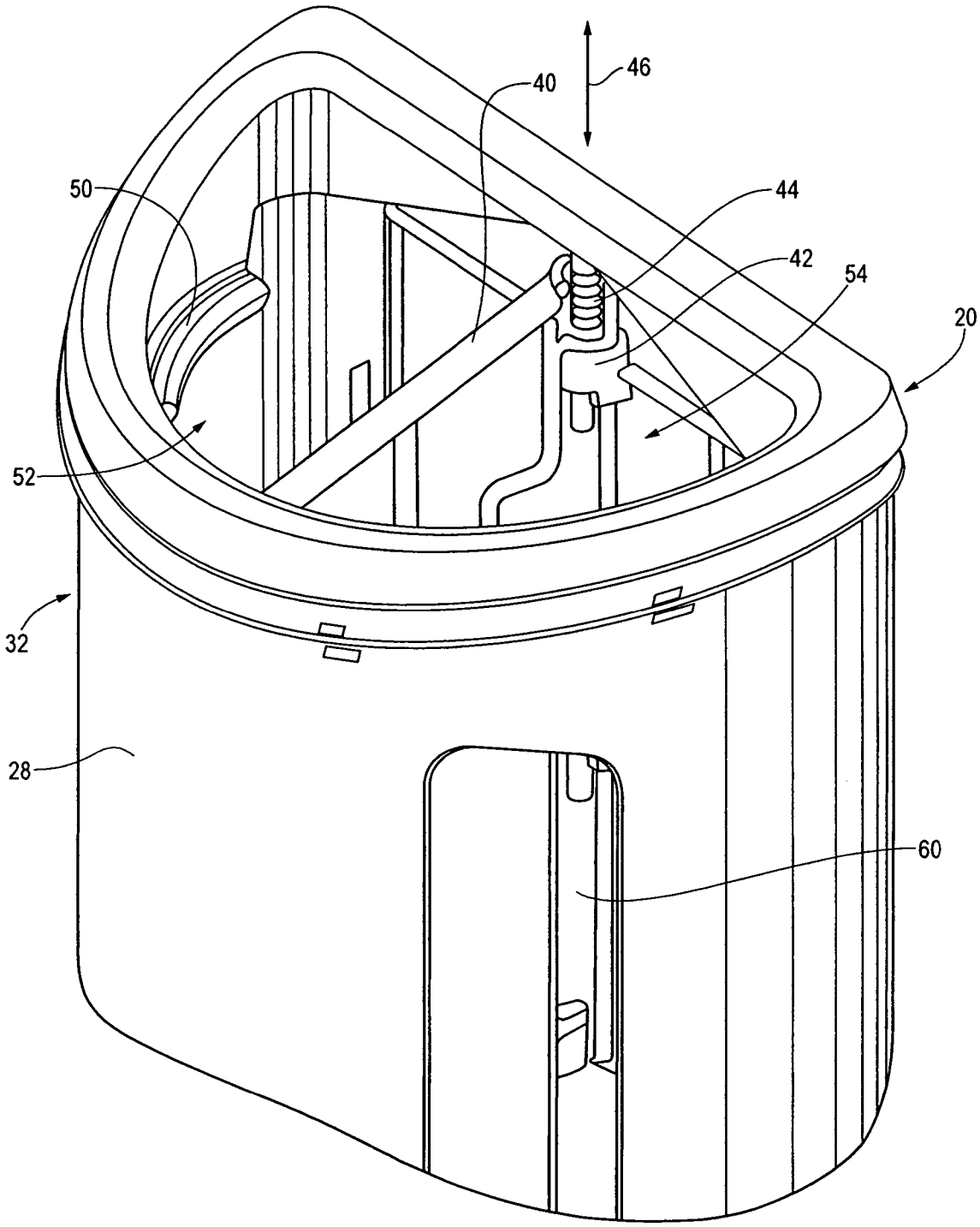
FIG. 7 is an enlarged perspective view of the top portion of one form of a bag dispenser.

The dispenser 20 also includes an adjustable divider 40. It should be understood that while only a single divider 40 is illustrated, multiple dividers 40 may be used. Furthermore, it should be understood that a single divider 40 may be separated into multiple divider portions, such that it includes upper and lower divider portions. Referring to FIGS. 1 and 7, the divider 40 is coupled to the dispenser 20 via a plurality of hinges 42. It should be understood that other methods and structure for coupling the divider 40 to the dispenser 20 are also contemplated. For example, one or more film hinges may be used as well as a single hinge and/or posts. In this form, the divider 40 is permitted to rotate about an axis, as represented by line 46.

Figure 9:
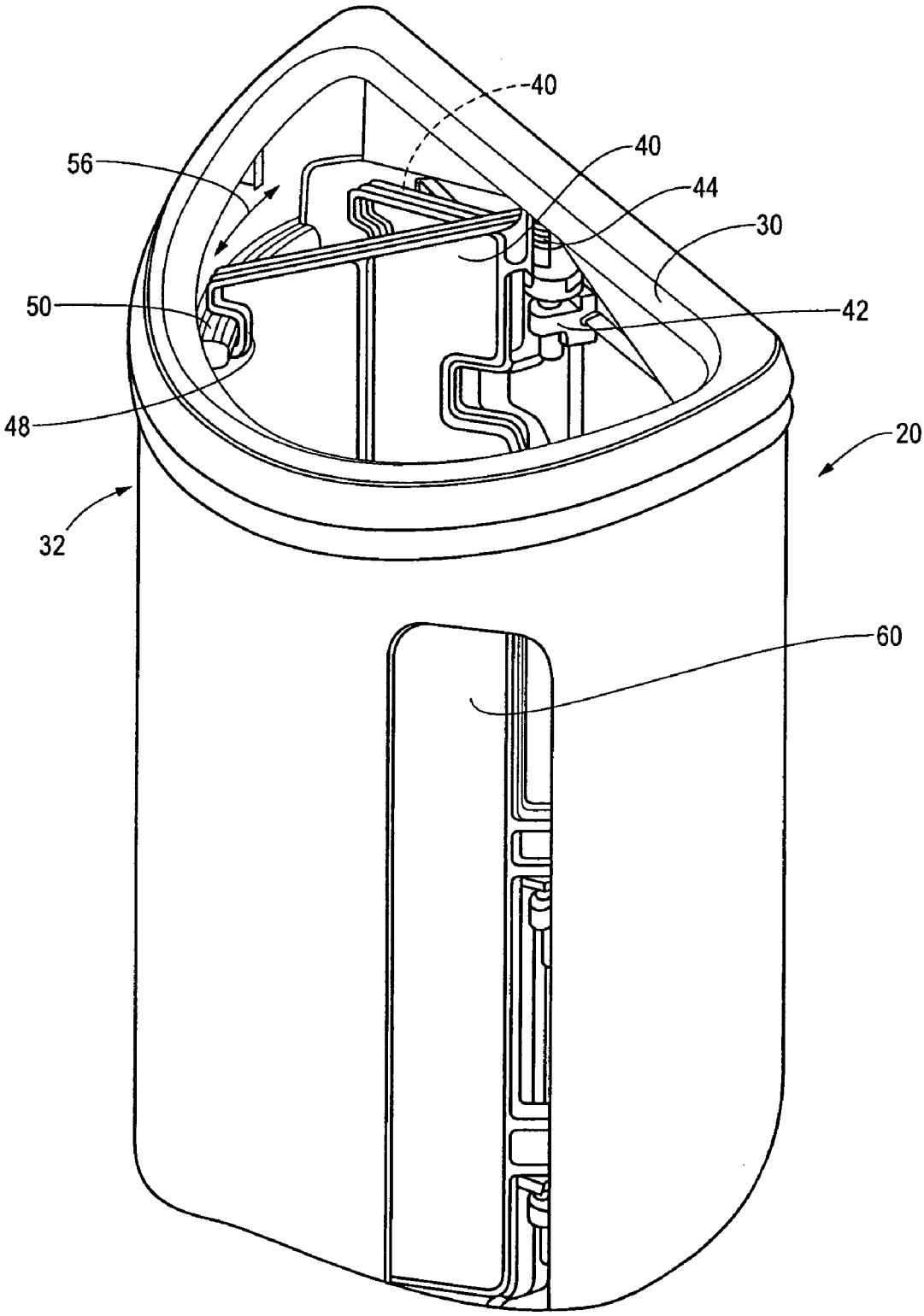
FIG. 9 is an enlarged perspective view of the top portion of one form of a bag dispenser depicting movement of the adjustable divider.

Referring to FIGS. 7 and 9, the dispenser 20 may also optionally include biasing structure, such as a spring 44. This biasing structure can be used to bias the divider 40 in one or more directions and be used to help maintain the divider 40 in a desired orientation. As shown in FIG. 7, the divider 40 is able to move vertically upwardly and downwardly, as shown by arrow 46. In this form, the spring 44 biases the divider 40 downwardly.

Figure 6:
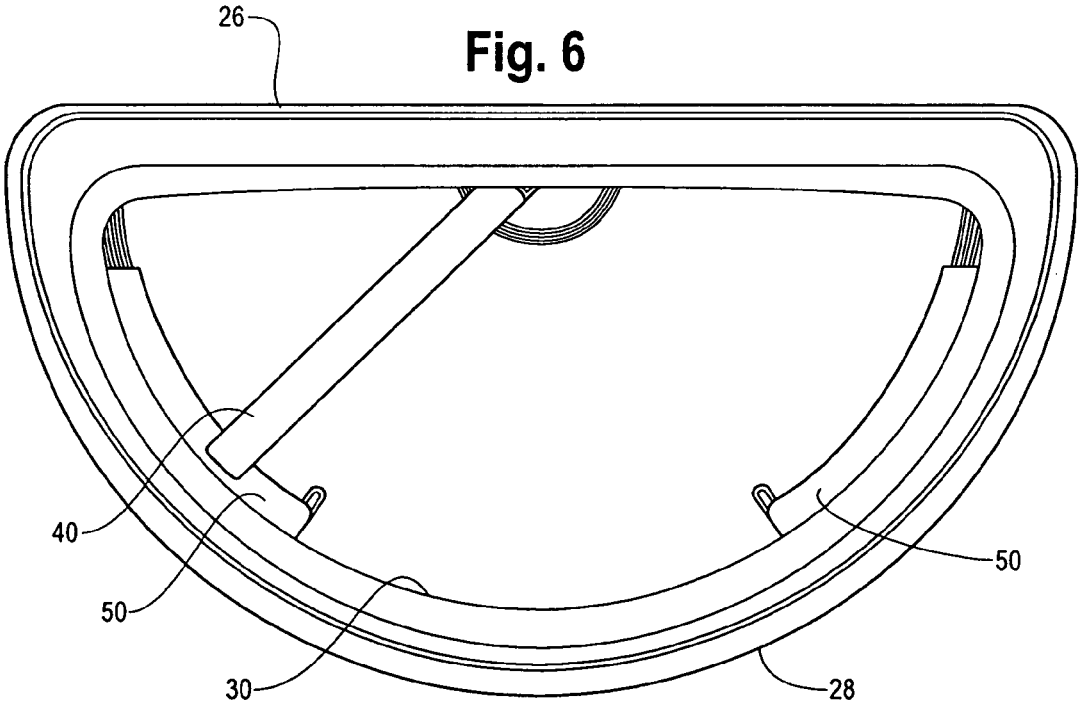
FIG. 6 is a top view of the bag dispenser of FIG. 1 moving towards a non-compartmentalizing position.
Figure 8:
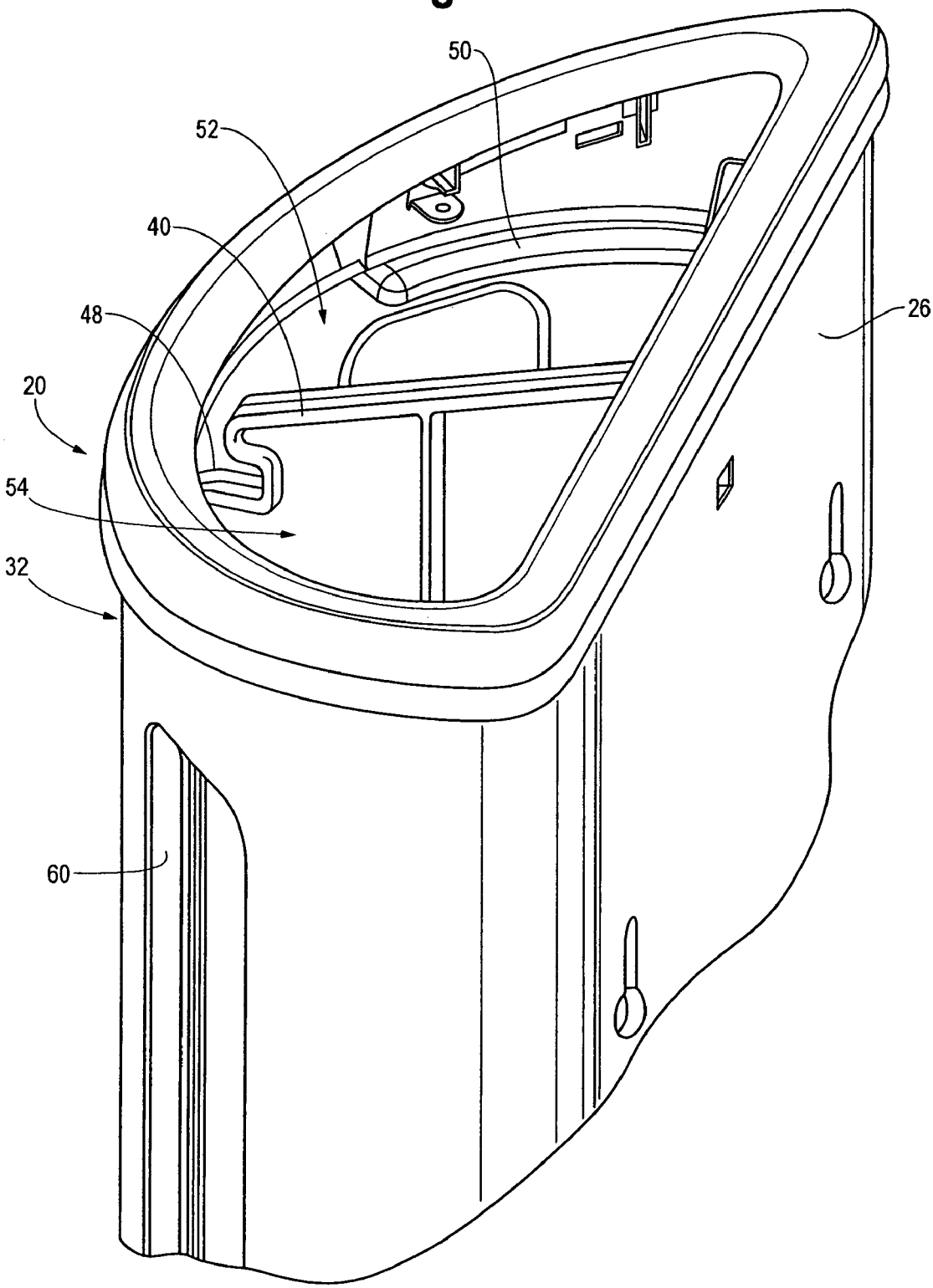
FIG. 8 is an enlarged perspective view of the top portion of one form of a bag dispenser.

The divider 20 may also include a groove 48, as best seen in FIGS. 8 and 9. The groove 48 can be used to cooperate with one or more protrusions 50 on the inner chamber 24. For example, in the form with a biasing structure, such as the spring 44, the spring biases the divider 40 downwardly such that the protrusion 50 is not permitted to enter the groove 48. In this manner, the divider 40 is prevented from moving beyond the locations of the protrusions. However, if it is desired to move the divider 40 beyond the location of the protrusions 50, a user can lift the divider 40 upwardly to thereby engage the protrusion 50 with the groove 48 as shown in FIGS. 6 and 9. In another form, the spring 44 biases the divider 40 upwardly such that the divider 40 has to be pushed downwardly to engage the protrusion 50 with the groove 48. In yet another form, there is no spring 44 and therefore, the user can simply move the divider as desired to engage or disengage the protrusion 50 and the groove 50.

Alternatively, the divider 40 does not include any spring 44 and the groove 48 may cooperate with a single protrusion 50 such that the protrusion 50 is always engaged with the groove 48. In this form, the interaction of the groove 48 and the protrusion 50 can provide additional strength and rigidity to the divider 40.

Figure 5:
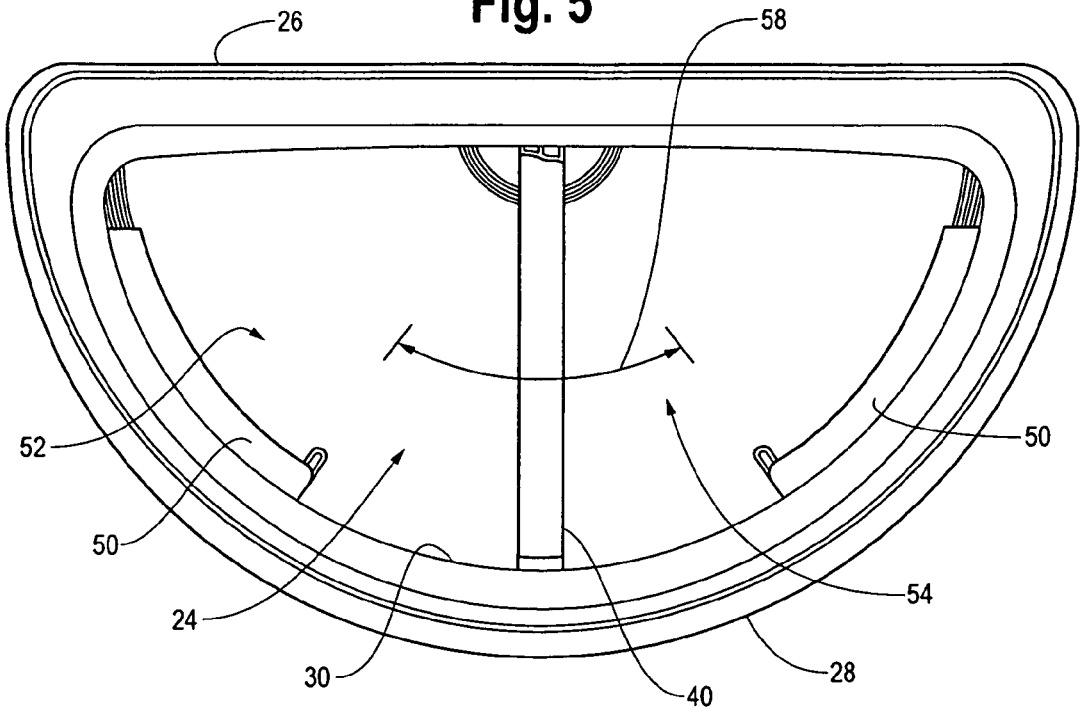
FIG. 5 is a top view of the bag dispenser of FIG. 1 in a compartmentalizing position.

As shown in the figures, the divider 40 can be used to define one or more compartments in the inner chamber 24. For example, as shown in FIG. 5, the divider 40 defines two chambers 52 and 54. The divider 40 is movable between a compartmentalizing position as shown in FIG. 5 and a non-compartmentalizing position, as shown by the phantom location of the divider 40 in FIG. 9. In the compartmentalizing position, the divider 40 creates a plurality of chambers, such as chambers 52,54 whereas in the non-compartmentalizing position, the divider defines a single compartment, such as compartment 54. In this manner, the divider 40 can be located against one or more of the walls, such as back wall portion 26. Referring again to FIG. 9, it can be seen that the divider moves along an arc 56 between the compartmentalizing position and the non-compartmentalizing position. It should be understood that other orientations of movement are also contemplated, such as, for example, lateral movement as in the case of a rectangular dispenser.

In one form, the divider 40 is self adjusting between the protrusions 50, as shown by arrow 58 in FIG. 5. In this manner, the divider 40 is permitted to travel between the protrusions 50 as the compartments 52,54 are filled with plastic bags. Therefore, as more bags are filled in one compartment 52,54 it will get bigger while the other compartment 52,54 will get smaller. It should be understood that the divider 40 may also be modified such that the divider 40 is not self adjusting and therefore requires the user to adjust the divider 40.

Figure 2:
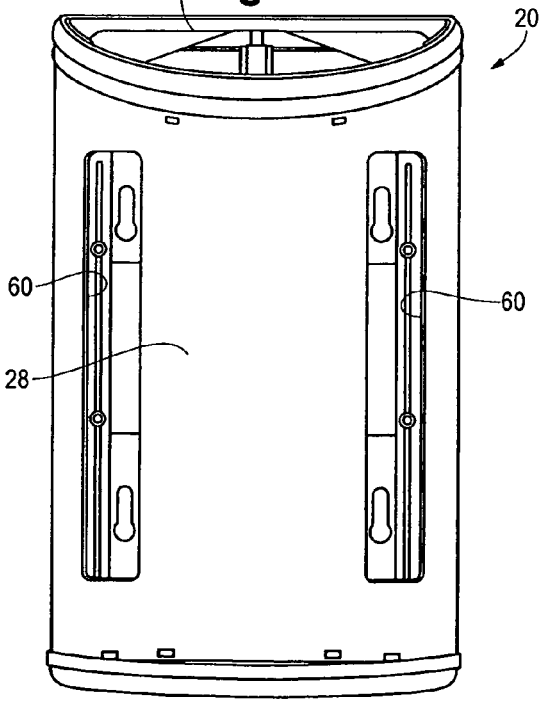
FIG. 2 is a front view of the bag dispenser of FIG. 1.
Figure 3:
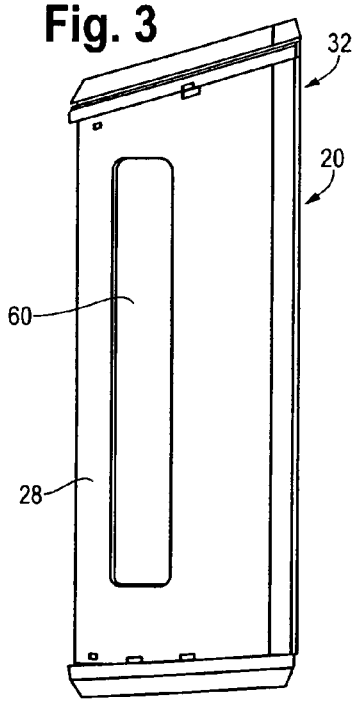
FIG. 3 is a side view of the bag dispenser of FIG. 1.

The dispenser 40 further includes one or more openings 60 to remove plastic bags from the respective compartments 52,54. As shown in FIG. 2, the dispenser includes two openings 60. However, it should be understood that additional openings 60 may be included.

Figure 4:
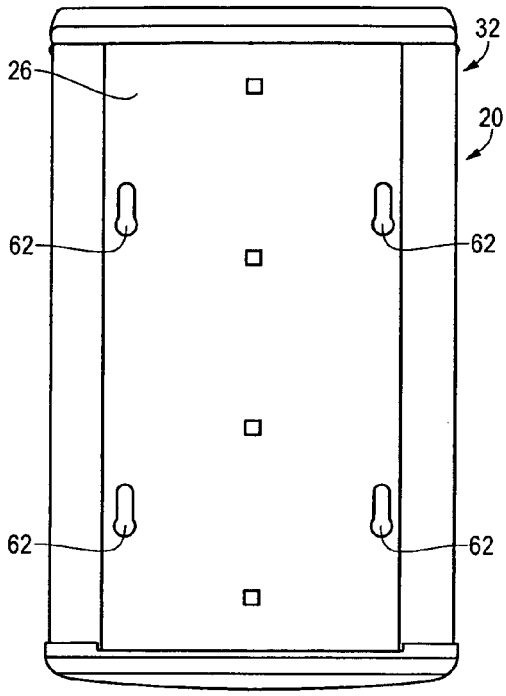
FIG. 4 is a rear view of the bag dispenser of FIG. 1.

The dispenser 20 can be operated from a variety of locations. For example, the dispenser can be located on a counter top or a floor. Alternatively, the dispenser 20 can include wall mounting structure, such as mounting holes 62, as best seen in FIG. 4. These holes 62 can be used to cooperate with screws or other structure in a wall or on a door to mount the dispenser 20. The dispenser 20 can include any number of holes 62 as desired. It should be understood that other forms of mounting structure are also contemplated.

Figure 10:
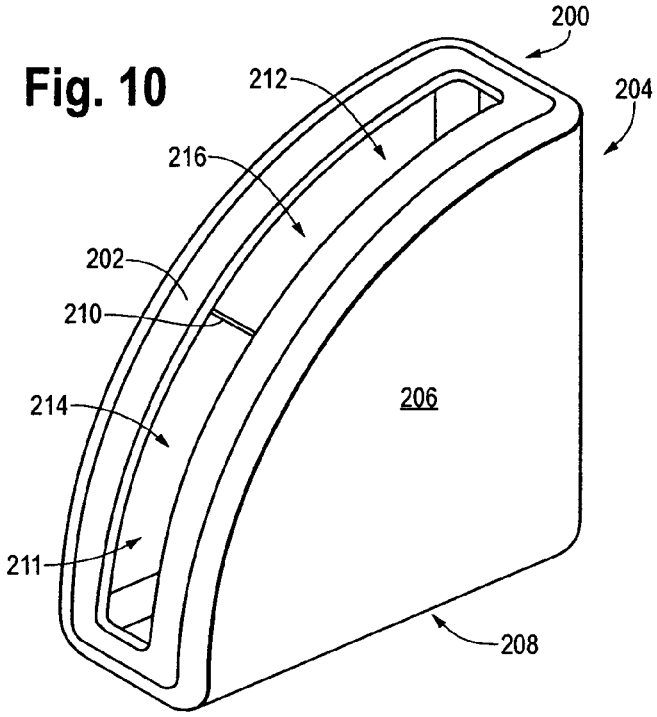
FIG. 10 is a perspective view on an alternative form of a bag dispenser.
Figure 12:
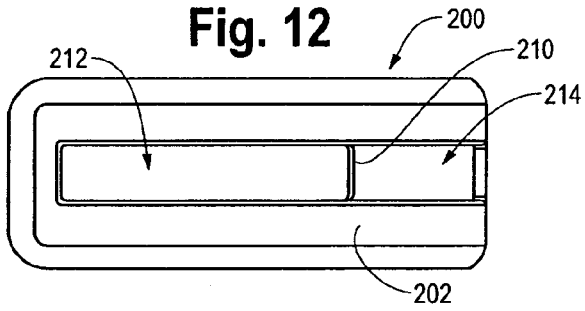
FIG. 12 is a top view of the bag dispenser of FIG. 10.
Figure 14:
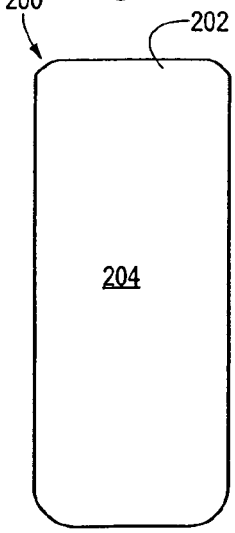
FIG. 14 is a rear view of the bag dispenser of FIG. 10.
Figure 13:
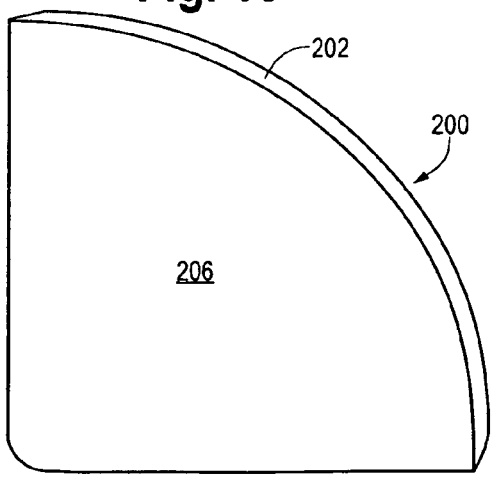
FIG. 13 is a side view of the bag dispenser of FIG. 10.
Figure 11:
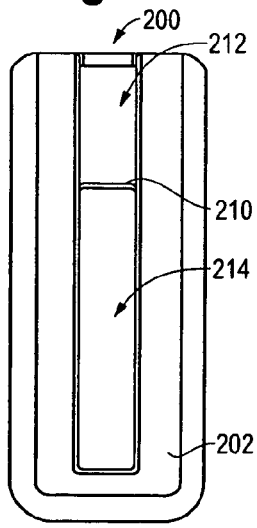
FIG. 11 is a front view of the bag dispenser of FIG. 10.

Referring to FIGS. 10-14, an alternative form of a dispenser 200 is shown. In some cases, this form may be more easily located in a convenient orientation on a user's counter. The dispenser 200 includes a front wall 202, a rear wall 204, side walls 206 and a bottom wall 208. The dispenser 200 also includes a divider 210 which can divide an inner chamber 211 into chambers 212, 214. This divider 210 operates similarly to that described above. The dispenser 200 can also include further structure as described above, including, but not limited to, springs, protrusions, grooves and the like. Additionally, the dispenser 200 can include any number of openings. For example, as shown in FIG. 10, the dispenser has a single opening 216. In this manner the plastic bags are inserted and removed via the same opening. However, it should be understood that any number of openings may be utilized as desired.

It should be understood that the dispenser 20, 200 can include a variety of shapes, sizes and orientations. Further, the divider 40,210 can take a variety of different shapes, sizes and orientations. Furthermore, the divider 40,210 can move in a variety of manners. For example, the divider 40,210 can rotate about an axis, can move laterally, vertically or in any other manner to create one or more chambers.

It should be understood that the dispenser 20,200 can be made from a variety of different materials. For example, in one form, the dispenser 20,200 is made from plastic materials. In a preferred form, the dispenser 20,200 is made from one or more integrally molded components that are assembled together. It should be understood that the dispenser 20,200 can be made from other materials, including, but not limited to metal, rubber, wood and the like.

The matter set forth in the foregoing description and accompanying drawings is offered by way of illustration only and not as a limitation. While particular embodiments have been shown and described, it will be obvious to those skilled in the art that changes and modifications may be made without departing from the broader aspects of applicants' contribution. The actual scope of the protection sought is intended to be defined in the following claims when viewed in their proper perspective based on the prior art.

The invention claimed is:

1. A bag dispenser comprising:

at least one outer wall;

an inner chamber located within the at least one outer wall;

at least one opening in the at least one outer wall providing access to the inner chamber;

an adjustable divider located with the inner chamber, the adjustable divider being movable within the inner chamber between a compartmentalizing position to define a plurality of compartments within the inner chamber and a non-compartmentalizing position to define a single compartment within the inner chamber, wherein in the compartmentalizing position the adjustable divider is configured to automatically move over a free range of motion of the compartmentalizing position, each of the compartments is configured to store and dispense one or more bags;

a protrusion located on one of the inner chamber and the adjustable divider; and a groove located on the other of the inner chamber and adjustable divider, the protrusion cooperating with the groove to permit the adjustable divider to move between the compartmentalizing position and the non-compartmentalizing position, wherein the adjustable divider is biased to the compartmentalizing position whereby the protrusion is not permitted to enter the groove.

2. The bag dispenser of claim 1 wherein the adjustable divider is operably coupled to the inner chamber via a hinge to permit the adjustable divider to rotate about an axis.

3. The bag dispenser of claim 1 wherein the bag dispenser is capable of freely standing on a surface.

4. The bag dispenser of claim 1 wherein the bag dispenser is wall mountable.

5. The bag dispenser of claim 1 wherein at least a portion of the outer wall is arc-shaped and at least a portion of the inner chamber is arc-shaped.

6. The bag dispenser of claim 1 wherein the adjustable divider is spring biased along a hinge.

7. A bag dispenser comprising:

at least one outer wall;

an inner chamber located within the at least one outer wall;

a self-adjusting divider located within the inner chamber, the self-adjusting divider having a full range of motion for overall movement and a free range of motion whereby the divider can freely move; and movement restricting structure for restricting the self-adjusting movement of the divider to the free range of motion, wherein the movement restricting structure can be bypassed to increase to the full range of motion of the divider, wherein the movement restricting structure comprises a protrusion located on one of the inner chamber and the adjustable divider and a groove located on the other of the inner chamber and the adjustable divider, the protrusion cooperating with the groove to permit the adjustable divider to move between a compartmentalizing position and a non-compartmentalizing position and wherein the adjustable divider is biased to the compartmentalizing position whereby the protrusion is not permitted to enter the groove.

8. The bag dispenser of claim 7 wherein the adjustable divider is movable within the inner chamber to define a plurality of compartments.

9. The bag dispenser of claim 7 wherein the adjustable divider is movable within the inner chamber between the compartmentalizing position to define a plurality of compartments within the inner chamber and the non-compartmentalizing position to define a single compartment within the inner chamber.

10. The bag dispenser of claim 7 wherein the adjustable divider is operably coupled to the inner chamber via a hinge to permit the adjustable divider to rotate about an axis.

11. The bag dispenser of claim 7 wherein the bag dispenser is capable of freely standing on a surface.

12. The bag dispenser of claim 7 wherein the bag dispenser is wall mountable.

13. The bag dispenser of claim 7 wherein at least a portion of the outer wall is arc-shaped and at least a portion, of the inner chamber is arc-shaped.

14. The bag dispenser of claim 7 wherein the adjustable divider is spring biased along a hinge.

15. A bag dispenser comprising:

at least one outer wall;

an inner chamber located within the at least one outer wall;

at least one opening in the at least one outer wall providing access to the inner chamber;

an adjustable divider located with the inner chamber;

a protrusion located on one of the inner chamber and the adjustable divider; and a groove located on the other of the inner chamber and the adjustable divider, the protrusion cooperating with the groove to guide the adjustable divider between a compartmentalizing position and a non-compartmentalizing position, the adjustable divider being configured to automatically move over a free range of motion of the compartmentalizing position such that the protrusion does not engage the groove when in the compartmentalizing position, the compartmentalizing position configured to dispense bags from a plurality of compartments.

* * * * *